US012796868B2

(12) United States Patent
Chen

(10) Patent No.: US 12,796,868 B2
(45) Date of Patent: Nov. 17, 2026

(54) FOLDABLE BATHTUB

(71) Applicant: Zhejiang Babyhood Baby Products Co., Ltd., Taizhou (CN)

(72) Inventor: Guifang Chen, Taizhou (CN)

(73) Assignee: Zhejiang Babyhood Baby Products Co., Ltd., Taizhou (CN)

( * ) Notice: Subject to any disclaimer, the term of this patent is extended or adjusted under 35 U.S.C. 154(b) by 104 days.

(21) Appl. No.: 18/934,288

(22) Filed: Nov. 1, 2024

(65) Prior Publication Data

US 2025/0386978 A1 Dec. 25, 2025

(30) Foreign Application Priority Data

Jun. 25, 2024 (CN) ..... 202421462483.2

(51) Int. Cl.
*A47K 3/06* (2006.01)

(52) U.S. Cl.
CPC ..... *A47K 3/06* (2013.01)

(58) Field of Classification Search
CPC ..... A47K 3/064
USPC ..... 4/585
See application file for complete search history.

(56) References Cited

U.S. PATENT DOCUMENTS 2,950,484 A * 8/1960 Jaffe ..... A47K 3/064 5/98.1
2022/0079390 A1* 3/2022 Pruzhansky ..... A47K 3/024

FOREIGN PATENT DOCUMENTS

WO WO-2007129883 A1 * 11/2007 ..... A47K 3/064

* cited by examiner

*Primary Examiner* — Lauren A Crane

(57) ABSTRACT

The disclosure relates to the field of bathtubs, more particularly to a foldable bathtub. The disclosure provides a foldable bathtub, comprising a tub body, supporting members, a foldable portion, and a reinforcing element. The tub body defines an accommodating space. The supporting members are disposed on an upper edge of the tub body. Two supporting members are provided and are spaced apart; The foldable portion is arranged between the two supporting members, and provided with a first side surface and a second side surface along a thickness direction thereof; The reinforcing element is connected with at least one of the two supporting members, the reinforcing element has a strength greater than that of the foldable portion, and the reinforcing element covers at least a portion of the first side surface and at least a portion of the second side surface.

7 Claims, 4 Drawing Sheets

FOLDABLE BATHTUB

CROSS-REFERENCE TO PRIOR APPLICATION

This application claims the benefit of the priority of Chinese Patent Application No. 202421462483.2 filed on Jun. 25, 2024, the contents of which are incorporated herein by reference.

TECHNICAL FIELD

The disclosure relates to the field of bathtubs, more particularly to a foldable bathtub.

BACKGROUND

For families with children, bathtubs are commonly used to bathe children. However, the bathtubs which occupy a lot of space due to large sizes are difficult to store. In addition, the bathtub is unaesthetic when being left exposed. Consequently, it needs to provide a foldable bathtub to solve the storage problem. Although foldable bathtubs can facilitate storage, they may have reduced strength and thus potential safety risk during use in the unfolded state. Thus, it is desired to provide a bathtub that is foldable to facilitate storage and meanwhile has sufficient strength.

SUMMARY

The disclosure provides a foldable bathtub to solve the technical problem of insufficient strength of the bathtub.

In order to solve the above technical problem, the disclosure provides a foldable bathtub, comprising a tub body, supporting members, a foldable portion, and a reinforcing element. The tub body defines an accommodating space. The supporting members are disposed on an upper edge of the tub body, a number of the supporting members is two, and the two supporting members are spaced apart; The foldable portion is arranged between the two supporting members, and provided with a first side surface and a second side surface along a thickness direction thereof; The reinforcing element is connected with at least one of the two supporting members, the reinforcing element has a strength greater than that of the foldable portion, and the reinforcing element covers at least a portion of the first side surface and at least a portion of the second side surface.

In some embodiments of the disclosure, the supporting members may comprise a first portion and a second portion, the first portion may be connected with the upper edge of the tub body and extend in a vertical direction, and the second portion may be connected with an upper end of the first portion and form an angle with the first portion.

In some embodiments of the disclosure, the foldable portion may be connected between two first portions and extend in the vertical direction.

In some embodiments of the disclosure, the first portion may comprise a first body portion and a first protruding portion which are arranged along a circumferential direction of the tub body, the first body portion may be connected with the upper edge of the tub body and the second portion, and the first protruding portion may be located at a corresponding end of the second portion; wherein the reinforcing element may be connected with the first protruding portion and cover at least one of the two opposite side surfaces of the first protruding portion which are arranged along the thickness direction.

In some embodiments of the disclosure, in a thickness direction of the first protruding portion, an outer surface of an area of the first body portion proximal to the first protruding portion may protrude beyond an outer surface of the first protruding portion, and/or in the thickness direction of the first protruding portion, an inner surface of an area of the first body portion proximal to the first protruding portion may protrude beyond an inner surface of the first protruding portion.

In some embodiments of the disclosure, the foldable portion may comprise a third portion and a fourth portion, wherein the third portion may be connected with the upper edge of the tub body and extend in the vertical direction, and the fourth portion may be connected with an upper end of the third portion and form an angle with the third portion; and wherein two side surfaces of the fourth portion arranged along the thickness direction may be respectively configured as the first side surface and the second side surface.

In some embodiments of the disclosure, the second portion may comprise a second body portion and a second protruding portion which are arranged along a circumferential direction of the tub body, the second body portion may be connected with an upper end of the first portion, the reinforcing element may be connected with the second protruding portion and cover at least one of the two opposite side surfaces of the second protruding portion arranged along the thickness direction.

In some embodiments of the disclosure, in a thickness direction of the second protruding portion, an upper surface of an area of the second body portion proximal to the second protruding portion may protrude beyond an upper surface of the second protruding portion; and/or in a thickness direction of the second protruding portion, a lower surface of an area of the second body portion proximal to the second protruding portion may protrude beyond a lower surface of the second protruding portion.

In some embodiments of the disclosure, the supporting members may further comprise a bending portion, the bending portion and the first portion may be respectively arranged at two ends of the second portion along a width direction of the second portion, and the bending portion and the first portion may be arranged opposite each other.

In some embodiments of the disclosure, the reinforcing element may be connected with the supporting members by snap-fitting connection.

Compared with the existing technologies, the disclosure has advantages as follows.

The disclosure provides the reinforcing element for covering the first side surface and second side surface of the foldable portion by insertion, and connect at least one of the two supporting members, the strength of the bathtub can be enhanced and thus the bathtub is safer to use. In addition, the structure is simple and is convenient to assemble. During use, it only needs to place the reinforcing elements onto the foldable portion by insertion. To facilitate storage of the bathtub, it only needs to remove the reinforcing elements, fold the bathtub in the vertical direction, and then fold it in half in the horizontal direction, thereby achieving multiple folds of the bathtub to save space.

Figure 1:
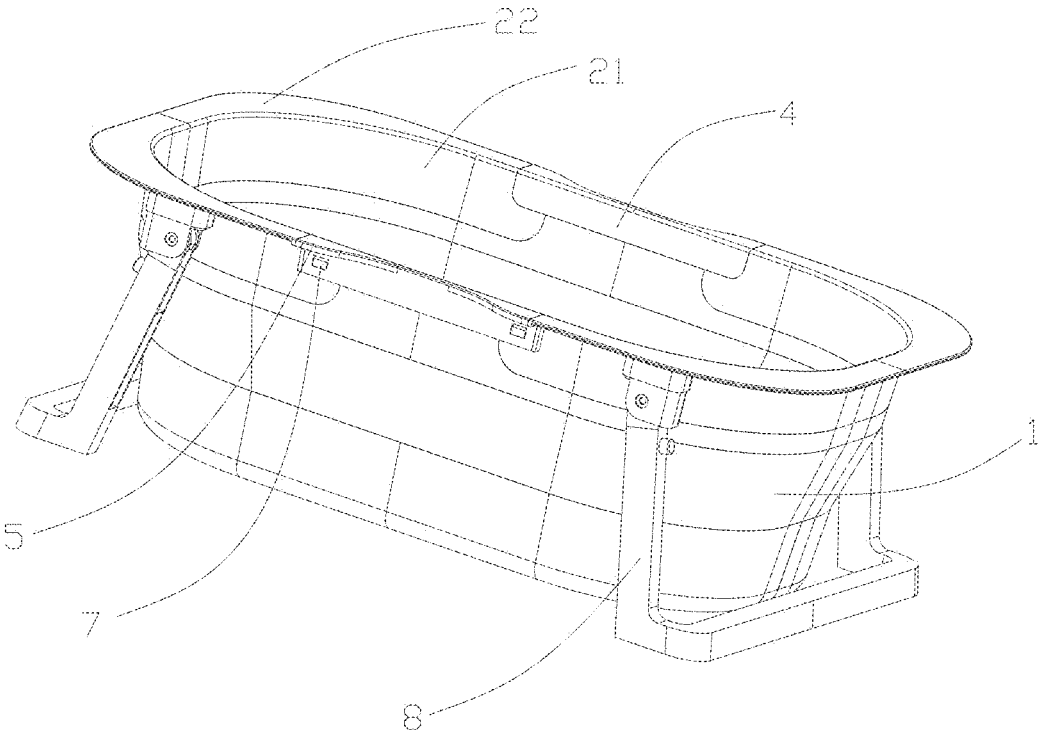
FIG. 1 is a schematic view according to an embodiment of the disclosure.

Herein, reference signs of the figures are as follows:

1. tub body; 2. supporting members; 21. first portion; 211. first body portion; 212. first protruding portion; 22. second portion; 221. second body portion; 222. second protruding portion; 23. bending portions; 3. foldable portion; 31. first side surface; 32. second side surface; 33. third portion; 34. fourth portion; 4. reinforcing elements; 41. third side wall; 42. fourth side wall; 43. fifth side wall; 44. groove; 5. extending portion; 6. end portion; 7. protrusions; 8. support legs.

DETAILED DESCRIPTION OF ILLUSTRATED EMBODIMENTS

The technical solutions of the embodiments of the present disclosure are clearly and completely described below with reference to the accompanying drawings in the embodiments of the present disclosure. Apparently, the described embodiments are merely a part rather than all of the embodiments of the present disclosure. All other embodiments obtained by those of ordinary skill in the art based on the embodiments of the present disclosure without creative efforts shall fall within the scope of the present disclosure.

Referring to FIGS. 1-6, a foldable bathtub according to an embodiment of the disclosure comprises a tub body 1, supporting members 2, a foldable portion 3, reinforcing elements 4, and support legs 8. The tub body 1 defines an accommodating space. The supporting members 2 are arranged on the upper edge of the tub body 1, respectively. The number of the supporting members 2 may be two, and the two supporting members 2 may be spaced apart. The foldable portion 3 is disposed between the two supporting members 2. The foldable portion 3 is provided with a first side surface 31 and a second side surface 32, which are arranged along the thickness direction. Each of the reinforcing elements 4 is connected with at least one of the two supporting members 2. The strength of the reinforcing elements 4 is greater than the strength of the foldable portion 3. One of the reinforcing elements 4 covers at least a portion of the first side surface 31 and at least a portion of the second side surface 32 respectively. The support legs 8 are rotatably connected with the tub body 1. When the bathtub is in a folded state, the support legs 8 are rotatable to be folded.

The reinforcing element 4 of the disclosure may cover the first side surface 31 and second side surface 32 of the foldable portion 3 by insertion, and connect at least one of the two supporting members 2, the strength and thus the safety of the bathtub can be enhanced. In addition, the structure is simple and is convenient to assemble. During use, it only needs to place the reinforcing elements 4 onto the foldable portion 3 by insertion. When it's necessary to store the bathtub, it only needs to remove the reinforcing elements 4, fold the bathtub in the vertical direction, and then fold it in half in the horizontal direction, thereby achieving multiple folds of the bathtub to save space.

Specifically, the two supporting members 2 are arranged circumferentially along the upper edge of the tub body 1 and are symmetrically distributed on the upper edge of the tub body 1. The foldable portion 3 is positioned between the two supporting members 2. The foldable portion 3 has a first side surface 31 and a second side surface 32 arranged along the thickness direction. The first side surface 31 and the second side surface 32 are arranged opposite each other. Both the first side surface 31 and the second side surface 32 extend in a direction perpendicular to the thickness direction of the foldable portion 3. The reinforcing element 4 covers at least a portion of the first side surface 31 and at least a portion of the second side surface 32 means that, the reinforcing element 4 which is placed on the foldable portion 3 by insertion covers at least a part of the foldable portion 3. Herein, the reinforcing element 4 has a third side wall 41, a fourth side wall 42, and a fifth side wall 43, wherein the fifth side wall 43 is connected with the third side wall 41 and the fourth side wall 42. A groove may be defined inside the reinforcing element 4 by the third side wall 41, the fourth side wall 42, and the fifth side wall 43, such that the reinforcing element 4 can be placed on the foldable portion 3 by insertion, with the foldable portion 3 being accommodated in the groove of the reinforcing element 4. Furthermore, the reinforcing element 4 may be connected with at least one of the supporting members 2 and have greater strength than the foldable portion 3. When the reinforcing element 4 covers two side surfaces of the foldable portion 3 and connects at least one of the supporting members 2, the strength of the foldable portion 3 can be enhanced. In such a case, when the tub body 1 is in an unfolded state, the foldable portion 3 has a sufficient strength, whereby the safety performance of the tub body 1 can be improved. It should be understood that the reinforcing element 4 may be connected with the supporting member 2 by snap-fitting or insertion, as long as the strength of the bathtub can be effectively reinforced by the connection between the supporting members 2 and the reinforcing element 4.

Figure 6:
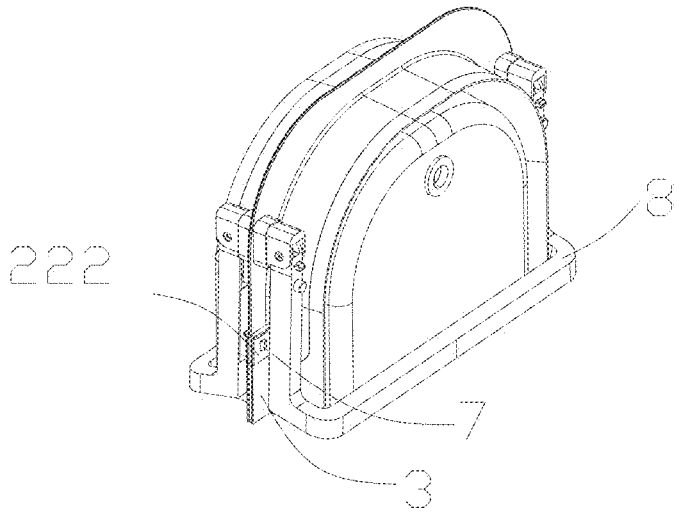
FIG. 6 is a schematic view illustrating a foldable bathtub of the disclosure in a folded state.

In one embodiment, the tub body 1 and foldable portion 3 are made of flexible materials and are integrally formed. Such bathtub can be folded in the vertical direction, and then folded in half in its horizontal direction along the foldable portion 3, thereby achieving multiple folds of the bathtub to save storage space. FIG. 6 illustrates the bathtub in the folded state.

It should be understood that the reinforcing element 4 may be connected with one or both of the supporting members 2 to ensure that the foldable portion 3 has sufficient strength to avoid dangers when the tub body 1 is in the unfolded state. Herein, each of the supporting members 2 may comprise only a portion extending in the same direction with the upper edge of the tub body 1. Similarly, the foldable portion 3 may comprise only a portion extending in the same direction with the upper edge of the tub body 1. In such a case, the reinforcing element 4 can be placed downwards in a vertical direction onto the foldable portion 3 by insertion. Herein, the vertical direction is not limited to a single one direction. Alternatively, the vertical direction may refer to the direction of gravity or a direction that forms a certain angle with the direction of gravity.

In an alternative embodiment, each of the supporting members 2 may comprise both the portion extending in the same direction with the upper edge of the tub body 1 and the portion forming an angle with the extension direction of the upper edge of the tub body 1. In other words, it may comprise two portions angled to each other. The foldable portion 3 may comprise two portions angled to each other, or comprise only the portion extending in the same direction with the upper edge of the tub body 1. In the case that the foldable portion 3 comprises two portions angled to each other, the reinforcing element 4 can be horizontally placed onto the foldable portion 3 by insertion. Herein, "horizontal" is not necessarily limited to absolute horizontal. Alternatively, it may refer to a direction at an angle of any size to the horizontal direction. In the case that the foldable portion 3 comprises only the portion extending in the same direction with the upper edge of the tub body 1, the reinforcing element 4 can be placed downwards in a vertical direction onto the foldable portion 3 by insertion. Herein, the vertical direction is not limited to a single one direction. Alternatively, the vertical direction may refer to the direction of gravity or a direction that forms a certain angle with the direction of gravity.

In an alternative embodiment, each of the supporting members 2 may comprise the portion extending in the same direction with the upper edge of the tub body 1, the portion forming an angle with the extension direction of the upper edge of the tub body 1, and the portion formed by bending the portion forming an angle with the extension direction of the upper edge of the tub body 1, such that a U-shaped groove is defined on the lower surface of the supporting member 2. However, the foldable portion 3 is formed without the portion formed by bending the portion forming an angle with the extension direction of the upper edge of the tub body 1, and no U-shaped groove is defined on the lower surface. Similarly, the foldable portion 3 may comprise the two portions angled to each other, or comprise only the portion extending in the same direction with the upper edge of the tub body 1. The particular connection methods are the same as above and are not repeated in detail.

Figure 2:
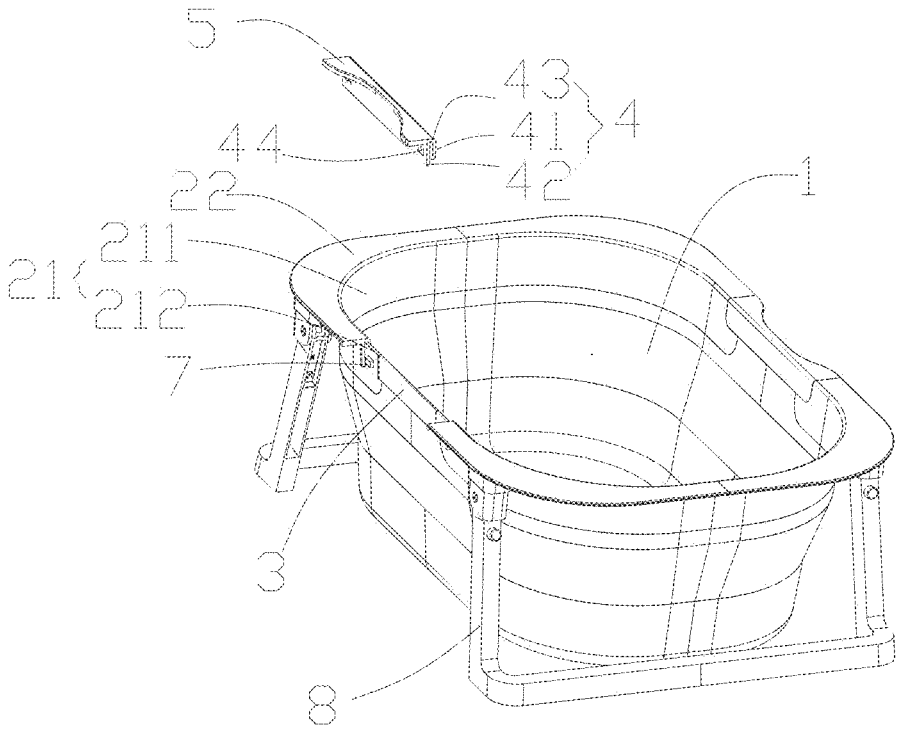
FIG. 2 is a partial exploded view of FIG. 1.
Figure 3:
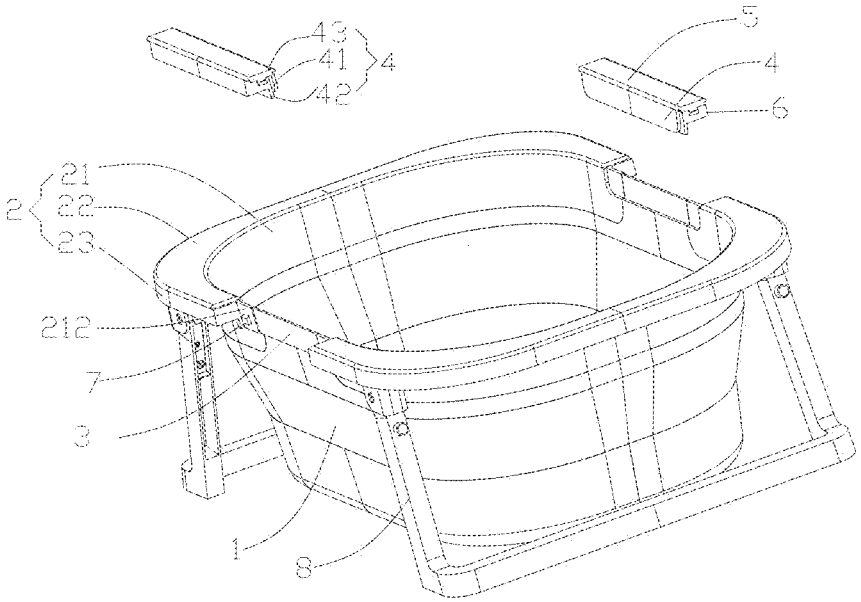
FIG. 3 is a partial exploded schematic view according to an embodiment of the disclosure.

Referring to FIGS. 1, 2, and 3, in some embodiments of the disclosure, each of the supporting members 2 may comprise a first portion 21 and a second portion 22, wherein the first portion 21 extends in a vertical direction and is connected with the upper edge of the tub body 1, and the second portion 22 is connected with the upper end of the first portion 21 and forms an angle with the first portion 21. It should be understood that, the first portion 21 is connected with the upper edge of the tub body 1 and extends in a vertical direction. Herein, the vertical direction is not limited to a single one direction. Alternatively, the vertical direction may refer to the direction of gravity or a direction that forms a certain angle with the direction of gravity. In other words, the extension direction of the first portion 21 may be the same as the extension direction of the upper edge of the tub body 1, and the second portion 22 may be connected with the upper end of the first portion 21 and form an angle with the first portion 21. The angle may be of any size, as long as a rim can be formed on the upper edge of the bathtub to facilitate movement by users. The disclosure is not so limited. In an alternative embodiment, the second portion 22 connected to the first portion 21 may have a curved wall.

In some embodiments of the disclosure, each of the supporting members 2 may further comprise a bending portion 23, the bending portion 23 and the first portion 21 may be respectively arranged at the two ends of the second portion 22 along the width direction of the second portion 22, and the bending portion 23 and the first portion 21 may be arranged opposite each other. In other words, the first portion 21 may be connected with the upper edge of the tub body 1, the second portion 22 may be connected with the first portion 21, and the bending portion 23 may be connected with the second portion 22. The first portion 21, the second portion 22 and the bending portion 23 may form a U-shaped structure.

In some embodiments of the disclosure, the foldable portion 3 may be connected between two first portions 21 and extend in a vertical direction. The first portions 21 may be connected with the upper edge of the tub body 1 and extend in a vertical direction, the foldable portion 3 may be connected between two first portions 21 of the two supporting members, the foldable portion 3 may extend in a vertical direction, and the reinforcing element 4 may be vertically placed onto the foldable portion 3 by insertion and may be connected with the supporting members 2.

In some embodiments of the disclosure, the first portion 21 may comprise a first body portion 211 and a first protruding portion 212 which are arranged along the circumferential direction of the tub body 1, wherein the first body portion 211 may be connected with the upper edge of the tub body 1 and the second portion 22, and the first protruding portion 212 is located at the corresponding end of the second portion 22. In such a case, the reinforcing element 4 is connected with the first protruding portion 212 and covers at least one of the two opposite side surfaces of the first protruding portion 212 which are arranged along the thickness direction. The first body portion 211 is connected between the second portion 22 and the upper edge of the tub body 1, the end portion of the first body portion 211 is aligned with the end portion of the second portion 22, the first protruding portion 212 is located at the corresponding end of the second portion 22, and the reinforcing element 4 can be placed onto the foldable portion 3 in a vertical direction by insertion. Furthermore, the reinforcing element 4 is connected with at least one side surface of the first protruding portion 212 in the thickness direction of the first protruding portion 212. It should be understood that both opposite side surfaces arranged along the thickness direction as described herein extend in a direction perpendicular with the thickness direction, and the reinforcing element 4 may be connected with one side surface or both opposite side surfaces of the first protruding portion 212 arranged along the thickness direction, as long as the sufficient strength of the bathtub can be ensured by the connection with the supporting members 2.

In some embodiments of the disclosure, the outer surface of the area of the first body portion 211 proximal to the first protruding portion 212 protrudes beyond the outer surface of the first protruding portion 212 in the thickness direction of the first protruding portion 212, and/or the inner surface of the area of the first body portion 211 proximal to the first protruding portion 212 protrudes beyond the inner surface of the first protruding portion 212 in the thickness direction of the first protruding portion 212. In other words, the thickness of the first body portion 211 may be greater than the thickness of the first protruding portion 212, the outer surface of the first body portion 211 may protrude beyond the outer surface of the first protruding portion 212, and the outer surface of the first protruding portion 212 may be lower than the outer surface of the first body portion 211; Alternatively, the inner surface of the first body portion 211 may protrude beyond the inner surface of the first protruding portion 212, the inner surface of the first protruding portion 212 may be lower than the inner surface of the first body portion 211; Alternatively, the outer surface of the first body portion 211 may protrude beyond the outer surface of the first protruding portion 212, and the inner surface of the first body portion 211 may protrude beyond the inner surface of the first protruding portion 212. Thus, the outer surface of the first protruding portion 212 may be lower than the outer surface of the first body portion 211, and the inner surface of the first protruding portion 212 may be lower than the inner surface of the first body portion 211. In such a case, the reinforcing element 4 can cover on the foldable portion 3 and the first protruding portion 212 in such a manner that the outer surface of the reinforcing element 4 is aligned with the outer surface of the first body portion 211, and/or the inner surface of the reinforcing element 4 is aligned with the inner surface of the first body portion 211.

It should be understood that the portion of the foldable portion 3 connected with the first protruding portion 212 has a similar structure as the first protruding portion 212. In the case that the outer surface of the first protruding portion 212 is lower than the outer surface of the first body portion 211, the first side surface 31 of the portion of the foldable portion 3 is lower than the outer surface of the first body portion 211, such that the first side surface 31 of the portion of the foldable portion 3 is aligned with the outer surface of the first protruding portion 212; Alternatively, in the case that the inner surface of the first protruding portion 212 is lower than the inner surface of the first body portion 211, the second side surface 32 of the portion of the foldable portion 3 is lower than the inner surface of the first body portion 211, such that the first side surface 31 of the portion of the foldable portion 3 is aligned with the outer surface of the first protruding portion 212; Alternatively, in the case that the outer surface of the first protruding portion 212 is lower than the outer surface of the first body portion 211 and the inner surface of the first protruding portion 212 is lower than the inner surface of the first body portion 211, the first side surface 31 of the portion of the foldable portion 3 is lower than the outer surface of the first body portion 211, and the second side surface 32 of the portion of the foldable portion 3 is lower than the inner surface of the first body portion 211, such that the first side surface 31 is aligned with the outer surface of the first protruding portion 212, and the second side surface 32 is aligned with the inner surface of the first protruding portion 212.

Consequently, it is ensured that when the reinforcing element 4 covers the foldable portion 3 and the first protruding portion 212, it can abut against both the foldable portion 3 and the first protruding portion 212, and the outer surface of the reinforcing element 4 is aligned with the outer surface of the first body portion 211, and/or the inner surface of the reinforcing element 4 is aligned with the inner surface of the first body portion 211. In this way, on one hand, it improves the aesthetics of the bathtub during use, and on the other hand, it provides smooth inner and outer surfaces of the bathtub and thus improves user experience.

In some embodiments of the disclosure, the reinforcing element 4 may be snap-fit to the supporting member. In other words, the first protruding portion 212 may be snap-fit to the reinforcing element 4. Specifically, the first protruding portion 212 may be provided with a protrusion, and the reinforcing element 4 may be provided with a groove 44 or a hole fitting with the protrusion. When the reinforcing element 4 is connected to the foldable portion 3, the protrusion may be snap-fit within the groove 44 or the hole of the reinforcing element 4, to allow the reinforcing element 4 to be fixedly connected with the first protruding portion 212. It should be understood that, according to the disclosure, the first protruding portion 212 may be snap-fit to the reinforcing element 4 in such a manner that the reinforcing element 4 is provided with a protrusion while the first protruding portion 212 is provided with a groove 44 or a hole. Alternatively, the first protruding portion 212 and the reinforcing element 4 can be connected through other engagement, or snap-fit, or detachable connection manners. The specific manners of connecting the reinforcing element 4 with the first protruding portion 212 can be determined depending on the particular use case, and the disclosure is not so limited.

Figure 4:
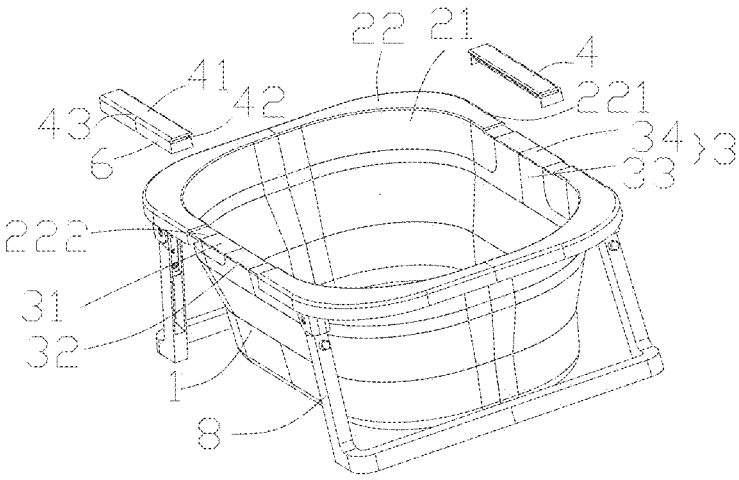
FIG. 4 is a partial exploded schematic view according to a further embodiment of the disclosure.
Figure 5:
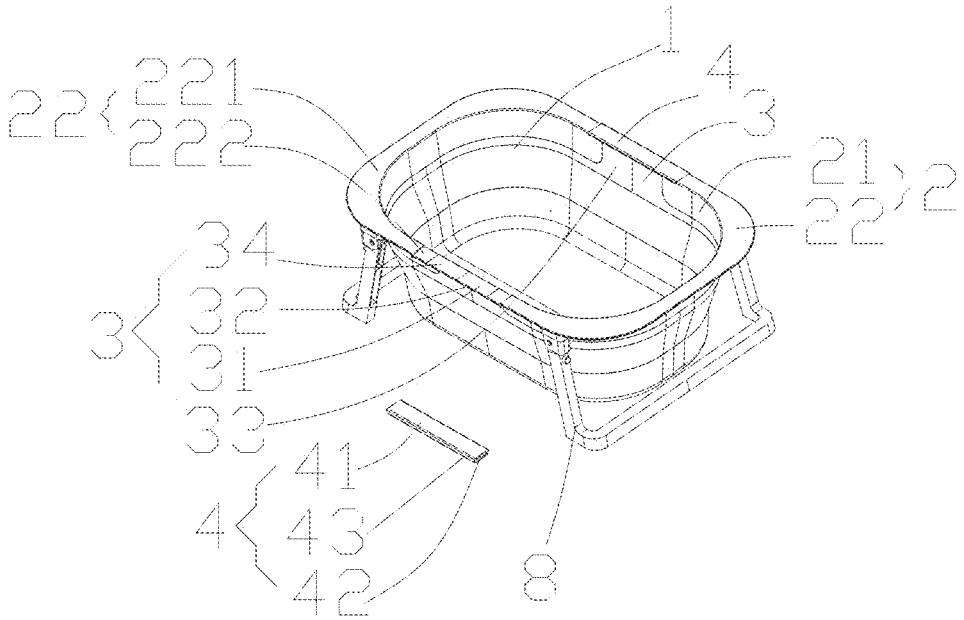
FIG. 5 is a partial exploded schematic view according to a further embodiment of the disclosure.

Referring to FIGS. 4 and 5, in further embodiments of the disclosure, the foldable portion 3 may comprise a third portion 33 and a fourth portion 34, wherein the third portion 33 may be connected with the upper edge of the tub body 1 and extend in a vertical direction, and the fourth portion 34 may be connected with the upper end of the third portion 33 and form an angle with the third portion 33. Herein, two side surfaces of the fourth portion 34 arranged along the thickness direction are respectively configured as the first side surface 31 and the second side surface 32. It should be understood that the third portion 33 may be disposed on the upper edge of the tub body 1 and extend in a vertical direction, and the fourth portion 34 may be connected with the upper end of the third portion 33. That is, the third portion 33 is connected between the fourth portion 34 and the upper edge of the tub body 1, and the fourth portion 34 forms an angle of any size with the third portion 33. Herein, the vertical direction is not limited to a single one direction. Alternatively, the vertical direction may refer to the direction of gravity or a direction that forms a certain angle with the direction of gravity.

Specifically, the third portion 33 is connected with the first portion 21, and the fourth portion 34 is connected with the second portion 22. The fourth portion 34 has two opposite side surfaces, i.e., the first side surface 31 and the second side surface 32, arranged along the thickness direction, and the first side surface 31 and the second side surface 32 extend in a direction perpendicular with the thickness direction. The reinforcing element 4 covers at least a portion of the first side surface 31 and at least a portion of the second side surface 32, and is connected with the second portion 22. In an alternative embodiment, the first side surface 31 and the second side surface 32 are provided by the fourth portion 34, the reinforcing element 4 covers the first side surface 31 and the second side surface 32 and is connected with the second portion 22.

In further embodiments of the disclosure, the second portion 22 may comprise a second body portion 221 and a second protruding portion 222 which are arranged along the circumferential direction of the tub body 1, wherein the second body portion 221 may be connected with the upper end of the first portion 21, the reinforcing element 4 may be connected with the second protruding portion 222 and cover at least one of the two opposite side surfaces of the second protruding portion 222 arranged along the thickness direction. The second body portion 221 may be connected with the upper end of the first portion 21, and the end portion of the second body portion 221 may be aligned with the end portion of the first portion 21. The second protruding portion 222 is located at the corresponding end of the first portion 21. The reinforcing element 4 can be placed onto the foldable portion 3 in a horizontal direction by insertion. Furthermore, the reinforcing element 4 is connected with at least one side surface of the second protruding portion 222 in the thickness direction of the second protruding portion 222. Herein, the horizontal direction is not limited to a single one direction. Alternatively, it may refer to a direction at an angle of any size to the horizontal direction. It should be understood that, both opposite side surfaces arranged along the thickness direction extend in a direction perpendicular with the thickness direction, and the reinforcing element 4 may be connected with one side surface or both opposite side surfaces of the second protruding portion 222 in the thickness direction, as long as the sufficient strength of the bathtub can be ensured by the connection with the supporting members 2.

In further embodiments of the disclosure, the upper surface of the area of the second body portion 221 proximal to the second protruding portion 222 may protrude beyond the upper surface of the second protruding portion 222 in the thickness direction of the second protruding portion 222; and/or the lower surface of the area of the second body portion 221 proximal to the second protruding portion 222 may protrude beyond the lower surface of the second protruding portion 222 in the thickness direction of the second protruding portion 222, such that the thickness of the second body portion 221 is greater than the thickness of the second protruding portion 222. Furthermore, the upper surface of the second body portion 221 protrudes beyond the upper surface of the second protruding portion 222, and the upper surface of the second protruding portion 222 is lower than the upper surface of the second body portion 221; Alternatively, the lower surface of the second body portion 221 protrudes beyond the lower surface of the second protruding portion 222, which means the lower surface of the second protruding portion 222 is higher than the lower surface of the second body portion 221; Alternatively, the upper surface of the second body portion 221 protrudes beyond the upper surface of the second protruding portion 222, and meanwhile the lower surface of the second body portion 221 protrudes beyond the lower surface of the second protruding portion 222. That is, the upper surface of the second protruding portion 222 is lower than the upper surface of the second body portion 221 and meanwhile the lower surface of the second protruding portion 222 is higher than the lower surface of the second body portion 221. In such a case, the reinforcing element 4 can cover on the foldable portion 3 and the second protruding portion 222 in such a manner that the upper surface of the reinforcing element 4 is aligned with the upper surface of the second body portion 211, and/or the lower surface of the reinforcing element 4 is aligned with the lower surface of the second body portion 221.

It should be understood that the fourth portion 34 of the foldable portion 3 has a similar structure as the second protruding portion 222. In the case that the upper surface of the second protruding portion 222 is lower than the upper surface of the second body portion 221, the first side surface 31 of the foldable portion 3 is lower than the upper surface of the second body portion 221, such that the first side surface 31 of the foldable portion 3 can be aligned with the upper surface of the second protruding portion 222; Alternatively, in the case that the lower surface of the second protruding portion 222 is lower than the lower surface of the second body portion 221, the second side surface 32 of the foldable portion 3 is lower than the lower surface of the second body portion 221, such that the first side surface 31 of the foldable portion 3 can be aligned with the upper surface of the second protruding portion 222; Alternatively, in the case that the upper surface of the second protruding portion 222 is lower than the upper surface of the second body portion 221 and the lower surface of the second protruding portion 222 is lower than the lower surface of the second body portion 221, the first side surface 31 of the foldable portion 3 is lower than the upper surface of the second body portion 221 and the second side surface 32 of the foldable portion 3 is lower than the lower surface of the second body portion 221, such that the first side surface 31 can be aligned with the upper surface of the second protruding portion 222, and the second side surface 32 can be aligned with the upper surface of the second protruding portion 222. It is ensured that, when the reinforcing element 4 covers the foldable portion 3 and the second protruding portion 222, it can abut against both the foldable portion 3 and the second protruding portion 222, and the upper surface of the reinforcing element 4 is aligned with the upper surface of the second body portion 221, and/or the lower surface of the reinforcing element 4 is aligned with the lower surface of the second body portion 221.

In further embodiments of the disclosure, he second protruding portion 222 may be snap-fit to the reinforcing element 4. Specifically, the second protruding portion 222 may be provided with a protrusion, and the reinforcing element 4 may be provided with a groove 44 or a hole fitting with the protrusion. When the reinforcing element 4 is connected to the fourth portion 34 of the foldable portion 3, the protrusion may be snap-fit within the groove 44 or the hole of the reinforcing element 4, to allow the reinforcing element 4 to be fixedly connected with the second protruding portion 222. It should be understood that, according to the disclosure, the second protruding portion 222 may be snap-fit to the reinforcing element 4 in such a manner that the reinforcing element 4 is provided with a protrusion while the second protruding portion 22 is provided with a groove 44 or a hole. Alternatively, the second protruding portion 222 and the reinforcing element 4 can be connected through other engagement, or snap-fit, or detachable connection manners. The specific manners of connecting the reinforcing element 4 with the two protruding portions can be determined depending on the particular use case, and the disclosure is not so limited.

In some embodiments of the disclosure, in order to improve the aesthetics of the bathtub, the supporting member 2 may be designed to be aligned with the end surface of the free end of the reinforcing element 4. Specifically, in the case that the supporting member 2 comprises the first portion 21 and the second portion 22 and the reinforcing element 4 is placed onto the foldable portion 3 in the vertical direction by insertion, the upper surface of the reinforcing element 4 may be provided with the extending portion 5 along its thickness direction. That is, the reinforcing element 4 is provided with the extending portion 5 extending in the vertical direction. Concerning the extending portion 5, at least the end surface of the free end thereof in connection with the second portion 22 may be aligned with the end surface of the free end of the second portion 22, as shown in FIGS. 1, 2, and 5. In other words, the entire end surface of the free end of the extending portion 5 may be aligned with the end surface of the free end of the second portion 22. Alternatively, the end surface of the free end in connection with the second portion 22 may be aligned with the end surface of the free end of the second portion 22, and meanwhile the middle portion of the extending portion 5 is tapered. In the case that the supporting member 2 comprises the first portion 21, the second portion 22, and the bending portion 23, the second portion 22 is connected between the first portion 21 and the bending portion 23, and the U-shaped groove is defined by the first portion 21, the second portion 22, and the bending portion 23. In the case that the reinforcing element 4 is vertically placed onto the foldable portion 3 by insertion, the reinforcing element 4 comprises the extending portion 5 connected with the second portion 22 and with the bending portion 23 and comprises the end portion 6, wherein the end portion 6, the extending portion 5, and the reinforcing element 4 form the U-shaped structure, as shown in FIG. 3; In the case that the reinforcing element 4 is horizontally placed onto the foldable portion 3 by insertion, reinforcing element 4 is further provided with the end portion 6 connected with the bending portion 23, wherein the end portion 6, the reinforcing element 4, and the third portion 33 of the foldable portion 3 form the U-shaped structure, as shown in FIG. 4.

All changes, equivalent arrangements and various modifications obtained by those of ordinary skill in the art based on the spirit and principle of the disclosure shall fall within the scope of the present disclosure.

The invention claimed is:

1. A foldable bathtub, comprising:

a tub body for defining an accommodating space;

supporting members disposed on an upper edge of the tub body, a number of the supporting members being two, and the two supporting members being spaced apart;

a foldable portion arranged between the two supporting members, and provided with a first side surface and a second side surface along a thickness direction thereof; and a reinforcing element connected with at least one of the two supporting members, having a strength greater than that of the foldable portion, and allowing for covering at least a portion of the first side surface and at least a portion of the second side surface;

wherein the supporting members comprise a first portion and a second portion, the first portion is connected with the upper edge of the tub body and extends in a vertical direction, and the second portion is connected with an upper end of the first portion and forms an angle with the first portion, wherein the foldable portion is connected between two first portions and extends in the vertical direction, wherein the first portion comprise a first body portion and a first protruding portion which are arranged along a circumferential direction of the tub body, the first body portion is connected with the upper edge of the tub body and the second portion, and the first protruding portion is located at a corresponding end of the second portion; and wherein the reinforcing element is connected with the first protruding portion and covers at least one of the two opposite side surfaces of the first protruding portion which are arranged along the thickness direction.

2. The foldable bathtub according to claim 1, wherein, in a thickness direction of the first protruding portion, an outer surface of an area of the first body portion proximal to the first protruding portion protrudes beyond an outer surface of the first protruding portion, and/or in the thickness direction of the first protruding portion, an inner surface of an area of the first body portion proximal to the first protruding portion protrudes beyond an inner surface of the first protruding portion.

3. The foldable bathtub according to claim 1, wherein the foldable portion comprises a third portion and a fourth portion, wherein the third portion is connected with the upper edge of the tub body and extend in the vertical direction, and the fourth portion is connected with an upper end of the third portion and form an angle with the third portion; and wherein two side surfaces of the fourth portion arranged along a thickness direction thereof are respectively configured as the first side surface and the second side surface.

4. The foldable bathtub according to claim 3, wherein the second portion comprise a second body portion and a second protruding portion which are arranged along a circumferential direction of the tub body, the second body portion is connected with an upper end of the first portion, the reinforcing element is connected with the second protruding portion and covers at least one of the two opposite side surfaces of the second protruding portion arranged along the thickness direction.

5. The foldable bathtub according to claim 4, wherein, in a thickness direction of the second protruding portion, an upper surface of an area of the second body portion proximal to the second protruding portion protrudes beyond an upper surface of the second protruding portion; and/or in the thickness direction of the second protruding portion, a lower surface of an area of the second body portion proximal to the second protruding portion protrudes beyond a lower surface of the second protruding portion.

6. The foldable bathtub according to claim 1, wherein the supporting members further comprise a bending portion, the bending portion and the first portion are respectively arranged at two ends of the second portion along a width direction of the second portion, and the bending portion and the first portion are arranged opposite each other.

7. The foldable bathtub according to claim 1, wherein the reinforcing element is connected with the supporting members by snap-fitting connection.

* * * * *